US005464221A

United States Patent [19]

Carney

[11] Patent Number: 5,464,221

[45] Date of Patent: Nov. 7, 1995

[54] GOLF CLUB PUTTER WITH LASER AIMING SYSTEM

[76] Inventor: William P. Carney, 4 High Ridge La., Oyster Bay, N.Y. 11771

[21] Appl. No.: 304,243

[22] Filed: Sep. 12, 1994

Related U.S. Application Data

[63] Continuation-in-part of Ser. No. 290,613, Aug. 15, 1994.

[51] Int. Cl.[6] ..... A63B 69/36

[52] U.S. Cl. ..... 273/186.3

[58] Field of Search ..... 273/186.2, 186.3, 273/194 R, 194 A, 162 R, 163 A, 163 R, 164.1, 164.2

[56] References Cited

U.S. PATENT DOCUMENTS

| | | | |
|---|---|---|---|
| 3,953,034 | 4/1976 | Nelson | 273/186.3 |
| 5,165,691 | 11/1992 | Cook | 273/186.3 |
| 5,169,150 | 12/1992 | Tindale | 273/186.3 X |
| 5,193,812 | 3/1993 | Hendricksen | 273/186.3 |
| 5,217,228 | 6/1993 | Aguilar | 273/186.3 |
| 5,374,063 | 12/1994 | Ogden | 273/186.3 |

*Primary Examiner*—George J. Marlo
*Attorney, Agent, or Firm*—Charles E. Temko

[57] ABSTRACT

A golf club putter with a self-contained laser aiming system is disclosed. The putter includes a shaft with a hollow length portion, a head with a golf ball striking face and a grip. The head includes a substantially sealed chamber in which a laser aiming module is mounted. The grip provides a substantially sealed chamber in which a voltage source and switch for energizing the laser module is mounted. A hollow length portion of the shaft provides a substantially sealed chamber through which the laser module is coupled to the voltage source. A user employs the laser aiming system to ensure proper club face alignment when practicing putting.

24 Claims, 7 Drawing Sheets

GOLF CLUB PUTTER WITH LASER AIMING SYSTEM

CROSS REFERENCE TO RELATED APPLICATION

This is a Continuation-in-Part of U.S. Patent application Ser. No. 08/290,613 filed Aug. 15, 1994, now pending.

BACKGROUND OF THE INVENTION

1. Field of the Invention

This invention relates to golf clubs and more particularly to a novel arrangement for mounting a laser aiming system in a putter.

2. Description of Related Art

Golf club laser aiming systems which provide golf club putters with laser aiming beams are well known in the art. Such systems are used by golfers as training aids when practicing putting. It is also generally accepted that a golfer achieves optimum putting practice on an actual putting green using the same putter as will be used on the course. Both private and public golf courses typically have practice greens so that a golfer may practice with his or her putter before going out to play a round of golf. Practice greens are maintained to replicate the greens on the course and thereby provide a player the opportunity to practice putting speed and putting direction under actual playing conditions.

Putting speed is partially a function of the condition of the green and partially a function of the head weight and feel of the putter. Putting direction is a function of the golfer's perception of proper club alignment, that is, how he or she aims the putter at the hole. Typically, a putter is properly aimed and aligned for a straight putt when the face of the putter is centered behind the ball and is perpendicular to the desired line or path of the ball.

On the practice green, a golfer gets a sense of the speed of the green by noting the speed of his or her actual putt. Similarly, a golfer develops a sense of proper club alignment by aiming his or her putter at a practice green pin located in the center of a practice green hole and after aiming the club and striking the ball, noting the actual direction of his or her putt.

The appearance of the club-ball relationship, the weight of the club head and the general feel of the putter are important factors which influence the development of a successful and repeatable putting stroke. Therefore, as was previously indicated, it is desirable for golfers to practice with the same putter they routinely use on the golf course. Further, because golfers are particular about the overall appearance of their clubs, it is desirable that any aiming device be completely concealed within the club. It is also desirable that the aiming device be suitable for use on a putting green without the need for constant and complicated laser beam aiming adjustments.

In addition, because putters are often used in a dusty and/or wet environment, it is highly desirable that the arrangement employed to conceal a laser module in the head of a putter be substantially sealed to protect the sensitive laser from the damaging effects of particulate contaminents and moisture. Given the harsh environment a putter is used in, it is also advantageous to be able to easily remove the laser module to service or replace it. Finally, since the laser modules in golf club putters are typically energized by batteries connected to the laser through a switch, it is important that such a power system be housed in the club so that it is substantially sealed from the effects of the environment.

The following United States Patents show prior art aiming systems to which the present invention is applicable:

U.S. Pat. No. 5,165,691, which issued on Nov. 24, 1992 to Jon C. Cook, discloses a golf club laser aiming system which comprises one or two laser generators mounted on the club head with the associated power source mounted in the club handle. Cook's disclosure does not describe the mounting implementation of the laser modules in the club head and does not specifically address the problem of mounting a concealed laser aiming system within the club which provides a laser beam projecting from the club directly above and essentially parallel to the desired path of a struck golf ball. The two parallel light beams, as disclosed, cannot be conveniently used to practice club alignment on a practice green having cups fitted with individual hole marking pins. Cook does not address the problem of providing a sealed or moisture resistent enclosure for the laser modules and does not define a housing arrangement which provides access for easy removal and replacement of the module. In addition, Cook does not disclose a substantially waterproof power pack.

U.S. Pat. No. 5,193,812, which issued on Mar. 16, 1993 to Mark W. Hendricksen, discloses a laser aiming device which attaches externally to the top of a club head by means of an attachment mounting bracket. The laser aiming device and associated bracket are located on the top of the head to provide a laser beam in a direction perpendicular to and above the club face and above the desired location on the club face for striking the ball. One of the disadvantages of this disclosure is that it adds a distracting and heavy appurtenance to the head of the club which can influence the user's visualization of the club-ball relationship and, therefore, his or her memory of a properly aligned putt. It does not address the problem of concealing the laser generator in the club in order to avoid affecting the appearance and feel of the putter while the golfer is practicing with the laser aiming system. In addition, the mounting bracket and laser module are affixed to the putter such that they not only affect the appearance and inertia of the club head but are also easily damaged when the putter is used on a golf course and is carried in a typical golf bag with other clubs. After practice, if Hendricksen's laser system is removed from the club head before taking the club on the course to play a round of golf, the user is faced with ensuring that the laser unit is properly aligned the next time it is mounted on the putter head. Further, Hendricksen teaches neither a substantially sealed laser mounting arrangement nor a substantially sealed power source.

U.S. Pat. No. 5,213,331, which issued on Mar. 25, 1993 to Frank Avanzini, discloses a laser aiming device which attaches to a club head by means of an adjustable mounting bracket. The laser unit and its associated bracket are adjustable in a vertical plane perpendicular to the putter's ball striking surface so that the laser beam may be projected over the top of a golf ball onto a putting surface at select distances in front of the golf ball. It does not disclose a means by which a laser aiming system can be concealed with a substantially sealed arrangement within a club and it does not disclose a means to mount a laser module in the head of the club without the need for an external mounting bracket. In addition, Avanzini's disclosure requires laser beam aiming adjustments for putts of varying distances.

U.S. Pat. No. 5,217,228, which issued on Jun. 8, 1993 to Juan De Aguilar, discloses a golf club having a head, a grip and a shaft which includes a laser generator and a reflecting mirror mounted in the shaft so as to emit a laser beam in a horizontal direction through a hole in the shaft at a point midway between the head and the grip. The aforementioned hole is a disadvantage because it provides an opening through which moisture and dust may enter the club and cause damage to the laser and/or the power source for the laser. De Aguilar does not address the problem of mounting a laser module in the head of a putter and does not disclose a club which is adapted to provide the user with a substantially sealed laser aiming system.

As can be seen from tile foregoing, there is a definite need for a golf club putter with a laser aiming system which does not significantly add to the weight of the club's head and which is concealed within the club so as not to affect the club's appearance. In addition, a system is needed which does not incorporate laser beams emitted from the striking face of the club in order to avoid damage to collimating lenses mounted on the striking surface. Also, a system is needed which enables the user to aim the laser at a pin with the ball in position to be putted. Further, a need exists for a mounting arrangement in a golf club which provides a substantially sealed enclosure to house the laser system which may be easily accessed to service or replace system components.

In summary, a putter with a laser aiming system is required that can be conveniently used on a practice green without constant beam adjustment and then taken on the course and used in a regular game of golf.

SUMMARY OF THE INVENTION

The present invention overcomes the above described disadvantages and provides a putter having a concealed laser aiming system which may not only be used for practice but may also be used in a regular game of golf. The putter arrangement also provides a substantially sealed mounting enclosure for the components of the self-contained laser aiming system.

In one aspect, the present invention comprises a shaft having a hollow length portion with a head secured at a first end of the shaft. The head has a face on a front side for striking a golf ball and a hosel on a top side securing the first end of the shaft. A grip is affixed at a second end of the shaft. The head has an inner cavity with a lateral bore in a front end therethrough and an access opening in an end thereof. The inner cavity communicates with the hosel and the hollow length portion of the shaft. A laser module is mounted in the inner cavity adapted to emit a laser beam coincident with the axis of the lateral bore. The laser module has first and second connection means for coupling opposite polarity electrical potentials from a voltage source to the laser module to cause the laser module to emit the laser beam. The first connection couples to the voltage source through the inner cavity, the hosel and the hollow length portion of the shaft. The laser beam is employed by a user of the club for controlling the direction of the golf ball.

In a second aspect, the golf club putter with laser aiming comprises an electrically conductive shaft having a hollow length portion. An electrically conductive head is secured at a first end of the shaft. The head has a face on a front side for Striking a golf ball and a hosel on a top side for securing a first end of the shaft. A grip is affixed to a second end of the shaft. The head includes an inner cavity having a lateral bore in a front end therethrough and an access opening in an end thereof. The inner cavity communicates with the hosel and the hollow length portion of the shaft. A laser module is mounted in the inner cavity adapted to emit a laser beam coincident with the axis of the lateral bore. The laser module has first and second conductive surfaces coupling opposite polarity electrical potentials, a first pole and a second pole, from a voltage source to the laser module to cause the laser module to emit a laser beam through the lateral bore. A first conductive element couples to the first pole of the voltage source from within the hollow length portion of the shaft through the hosel into said inner cavity, isolated from the shaft and the inner cavity, contacting the first conductive surface of the laser module. A second conductive element contacts the second conductive surface of the laser module coupling it to the second pole of the voltage source through the conductive head and the conductive shaft. The laser beam is employed by a user of the club for controlling the direction of said golf ball.

In a third aspect, a golf club putter with laser aiming comprises a shaft having a hollow length portion with a head secured at a first end of the shaft having a face on a front side for striking a golf ball and a hosel on a top side securing a first end of the shaft. A grip is secured at a second end of the shaft. The head has an inner cavity communicating with the hosel and the hollow length portion of the shaft. A laser module is mounted in the inner cavity having first and second connection means coupling first and second electrical poles from a voltage source to the laser module to cause the laser module to emit a laser beam through a front facing bore in the head. The voltage source and a switch controlling the voltage source are located in the second end of the shaft. The switch has first and second normally open switch elements which, when closed, couple the first pole of the voltage source to the first connection means of the laser module. The first switch element is coupled to the first electrical pole of the voltage source. The second switch element is coupled to the first connection means of the laser module through the hollow length portion of the shaft. A spring member in the second end of the shaft connects the second electrical pole of the voltage source to a conductive strip for coupling the voltage source to the laser module. The conductive strip is coupled to the second connection means of the laser module. The first and second switch elements are closed by finger pressure applied through the grip.

In a fourth aspect, a golf club putter providing a substantially sealed enclosure for mounting a laser aiming system therein comprises a shaft having a hollow length portion with a head secured at a first end of the shaft having a face on a front side for striking a golf ball and a hosel on a top side securing a first end of the shaft. A grip is affixed at a second end of the shaft. The head includes an inner cavity having a lateral bore in a front end therethrough and an access opening in an end thereof. The inner cavity communicates with the hosel and the hollow length portion of the shaft. The lateral bore is sealed by a lens and means for securing the lens in a front end thereof. The access opening is sealed by a cap. The shaft is sealed to the hosel by a hosel glue joint. The grip is sealed to the second end of the shaft by a grip glue joint. An access opening in the grip is closed by a grip cap having an interference fit with the second end of the shaft.

DETAILED DESCRIPTION OF THE INVENTION

Figure 1:
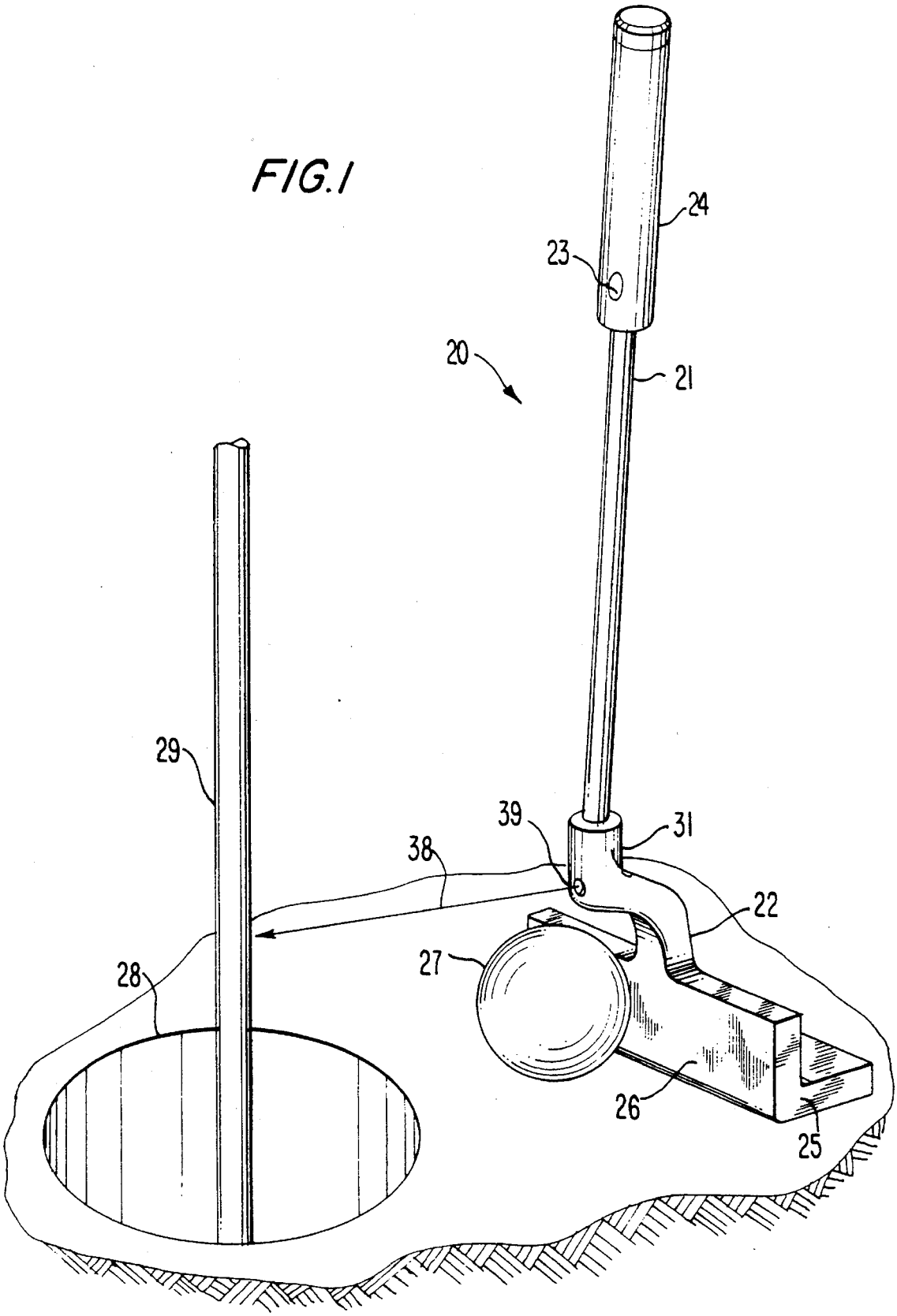
FIG. 1 is a perspective view of one embodiment of a golf club butter including the laser aiming system of the present invention.
Figure 2A:
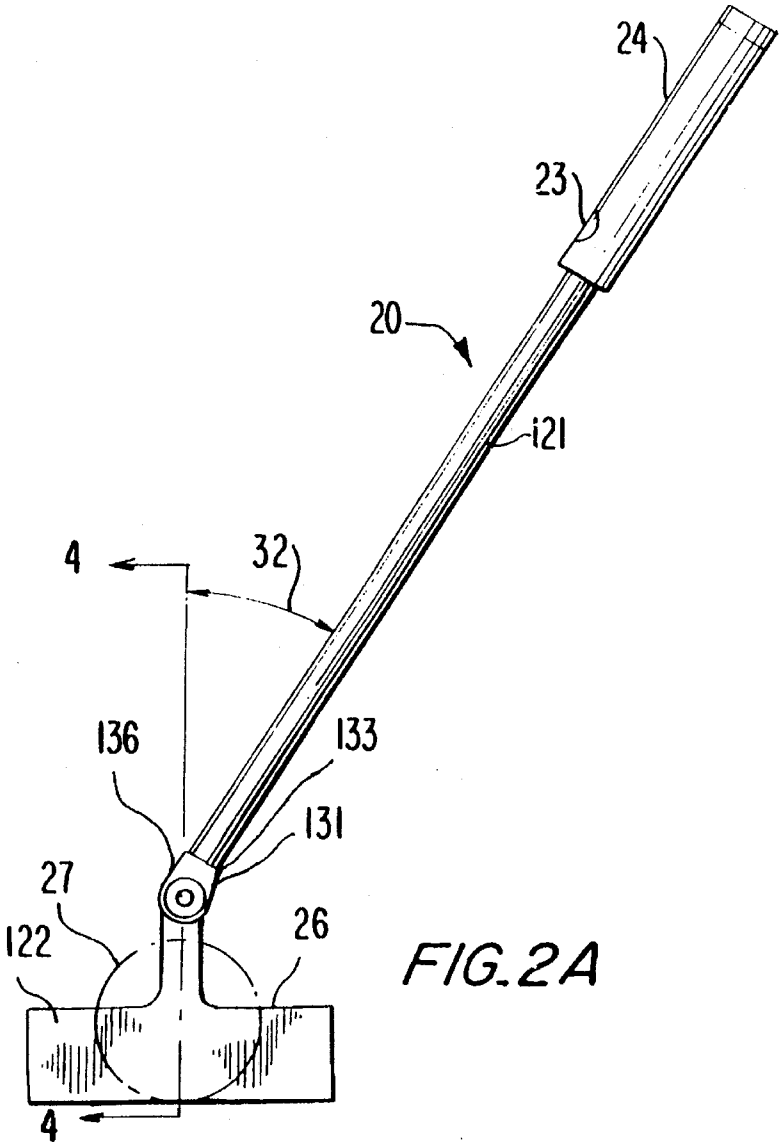
FIG. 2A is a front elevation of an alternate embodiment of the golf club putter shown in FIG. 2.
Figure 2:
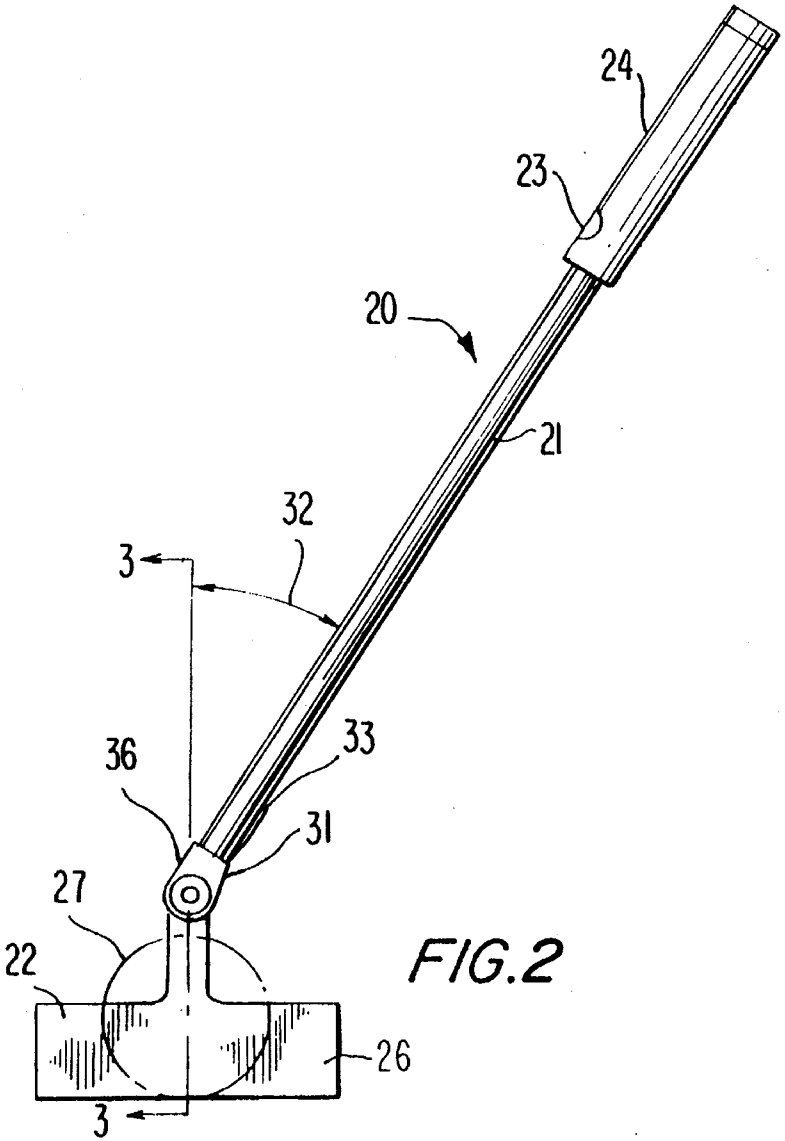
FIG. 2 is a front elevation of the golf club putter shown in FIG. 1.

As illustrated in FIGS. 1 and 2, a putter, generally referred to by reference number 20, comprises a shaft 21 having a hollow inner portion, a head 22 and a grip 24 which is used by a player to hold and align the club 20. The head 22 has a generally flat weighted heel portion 25 and an essentially vertical ball striking face 26. Shown in front of the ball striking face 26 is a golf ball 27 positioned to be putted into a cup 28 having a cup marking pin 29, the lower portion of which is shown located in the cup 28.

As will be described in detail below, there is mounted in the head 22 a laser module 36 that generates a laser beam 38 which is projected through a lateral bore 39 in the head 22 and which is used to aim the club 20. The laser module is powered by a voltage source contained in the shaft 21 and is controlled by a switch, also located in the shaft 21, activated by finger pressure applied at a pressure point 23 on the grip 24.

The type of head 22 shown is typically a one piece molding or casting fabricated from materials such as plastic molding resins or metallic casting metals such as brass, aluminum or steel. The head 22 includes an integral hosel 31 located in front of and above the face 26. The hosel 31 is disposed from vertical at a shaft angle 32 to receive and affix the shaft 21 in a close fitting shaft mounting hole 33. The vertical dimension of the hosel 31, the magnitude of the shaft angle 32 and the length of the shaft 21 determine the position of the player's hands when he or she holds the grip 24.

By mounting the laser beam generating module 36 in the head 22, the laser beam 38 may be positioned by the user above and adjacent to the top of the ball 27 as required for proper alignment with its location independent of the magnitude of the shaft angle 32. Thus, the shaft angle 32 may be adjusted by the user to suit his or her specific height requirements without affecting the aim of the laser system. Such an adjustment is accomplished by holding the hosel 31 and setting the angle 32 of the shaft 21 by applying a bending force at the grip 24.

When using the club 20 described in this embodiment to practice putting with the cup 28 and pin 29 illustrated in FIG. 1, the player aims the club 20 at the pin 29 before stroking a putt. The club is properly aligned if the laser beam 38, when aimed at the pin 29, passes over the top of the golf ball 27 in a horizontal direction perpendicular to and above the face 26 at a location where the golf ball 27 is positioned to be struck.

Figure 3:
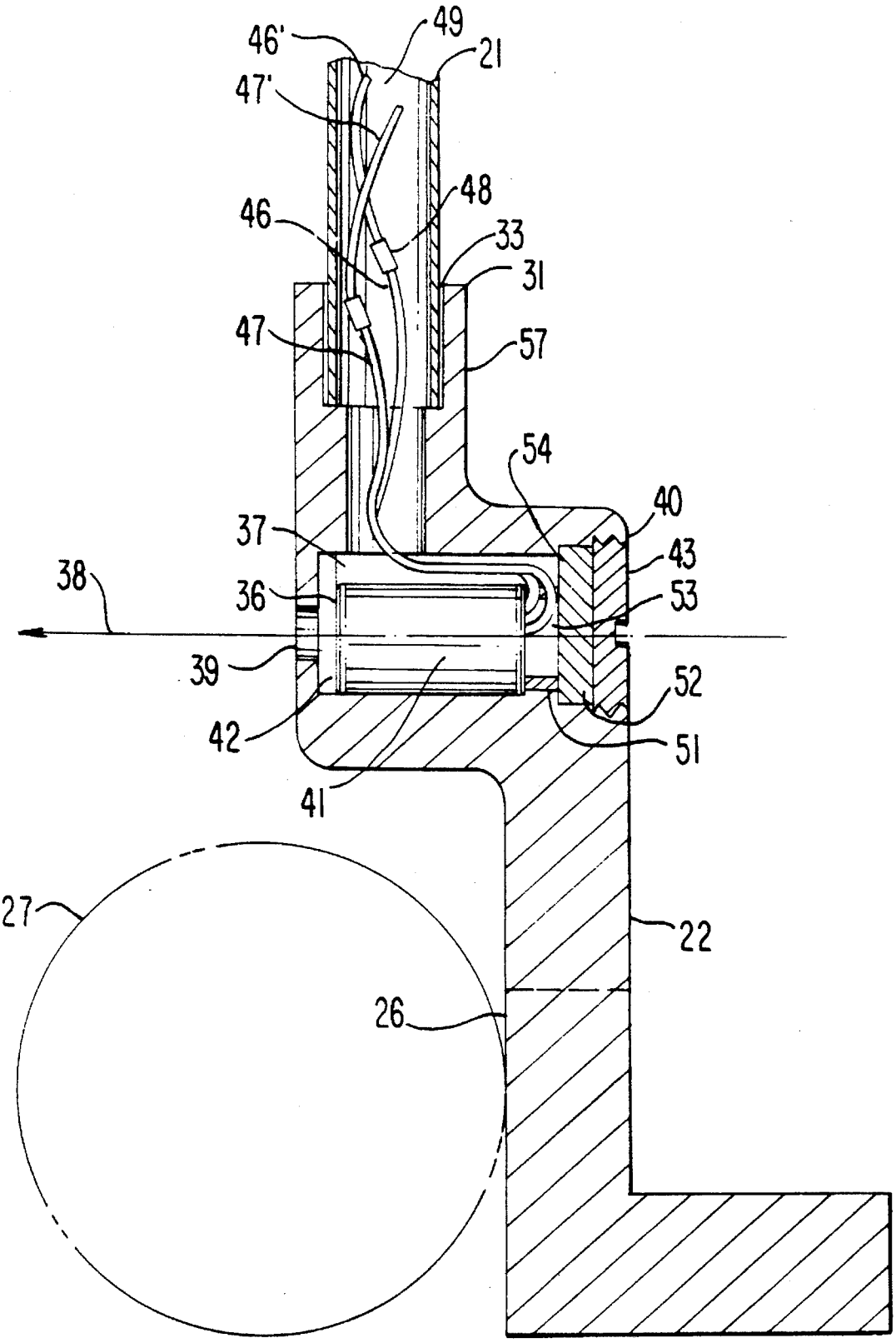
FIG. 3 is an enlarged fragmentary sectional view of the putter head shown in FIG. 2 taken along lines 3—3.
Figure 3A:
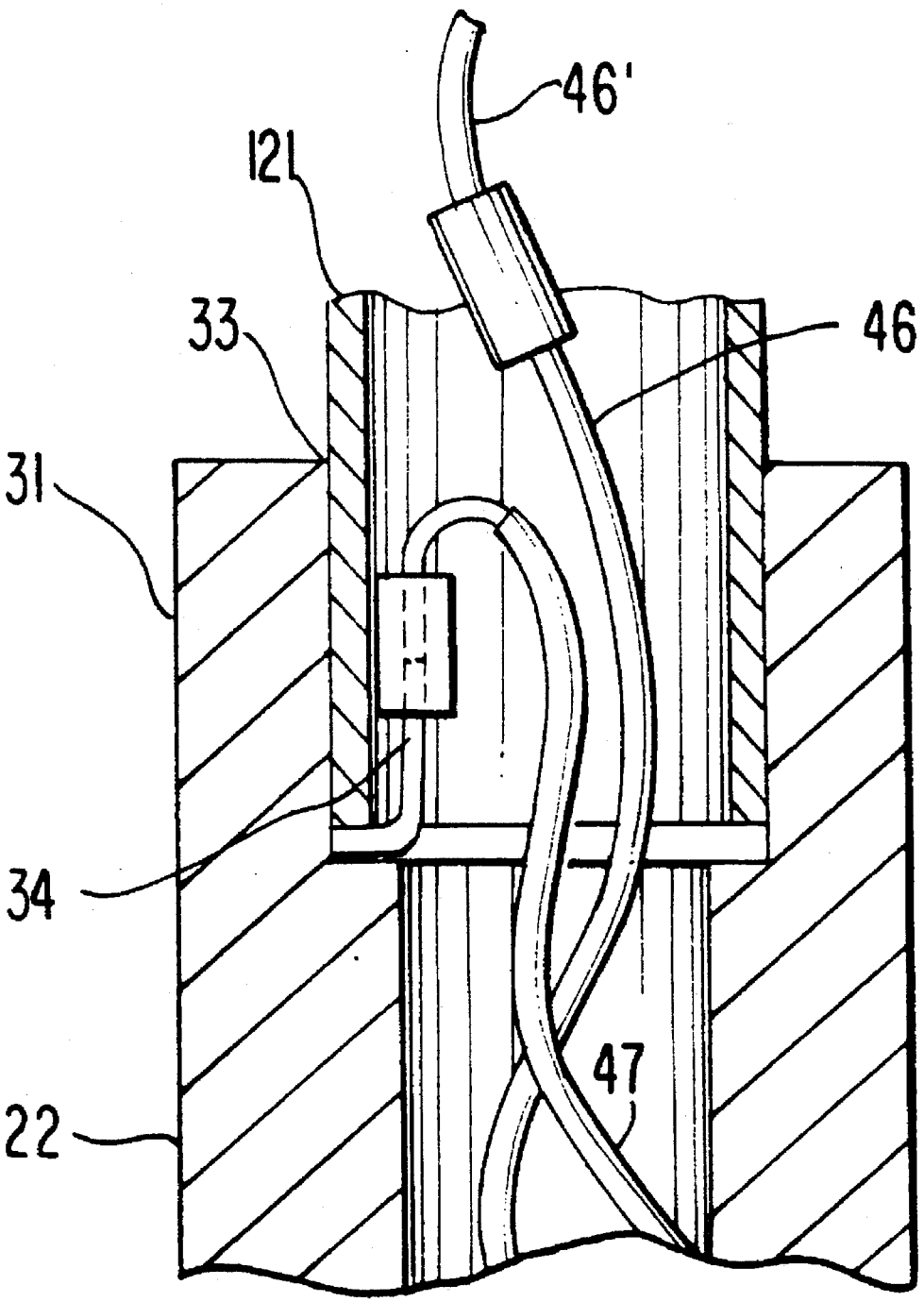
FIG. 3A is an enlarged fragmentary sectional view of an alternate embodiment of the hosel arrangement of the putter head shown in FIG. 3.

Referring now to FIGS. 3 and 3A, there are illustrated in the drawings enlarged sectional views of the putter head shown in FIG. 2 taken along lines 3—3. FIGS. 3 and 3A delineate the mounting arrangement of the laser beam generating module 36 contained in an inner cavity 37 in the head 22. The laser generating module 36 utilized in this embodiment is well known in the industry and may be purchased as a unit having a cylindrical housing 41 and having first and second insulated wire leads 46 and 47 which are used to couple first and second opposite polarity electrical potentials from the voltage source to energize the laser module 36. This type of device is available from any one of a number of vendors specializing in laser module assemblies such as Lyte optronics, santa Monica, Calif. The cylindrical module housing 41 is fitted laterally, as shown in FIG. 3, in the inner cavity 37 located in the head 22 and projects its laser beam 38 through a front facing lateral bore 39 in the head 22. The cylindrical module housing 41 slidably fits into the inner cavity 37 and a cap 43 is threaded into the rear access opening 40 of the inner cavity 37 to hold the laser module 36 in position.

Because putters are used in dusty and/or wet environments, it is desirable to provide a substantially sealed enclosure in the head 22 in which to mount the laser module 36. This is accomplished, in the present invention, by providing the inner cavity 37 with a transparent lens 42 suitably mounted, such as being glued, into the front end of the inner cavity 37 to seal the lateral bore 39. In addition, the rear end of the inner cavity 37 is closed by the threaded cap 43. Two resilient gaskets, doughnut shaped gasket 51 and disc shaped gasket 52, are sandwiched between the rear surface of the laser module 36 and the threaded cap 43. A clearance hole 53 in the doughnut shaped gasket 51 provides a bend relief and a passageway for the lead wires 46 and 47 routed from the laser module 36 between the resilient gaskets 51 and 52 into the inner cavity 37. The disc shaped gasket seals the threaded joint by being compressed between the threaded cap 43 and a lip 54 formed in the rear end of the inner cavity 37. To complete the sealing of the inner cavity 37, the shaft 21 is bonded to the head 22 by a hosel glue joint 57 in the interface between the outside diameter of the shaft 21 and the inside diameter of the shaft mounting hole 33.

In the present invention, the inner cavity 37 is formed during the molding or casting process in the head 22 with sufficient dimensional precision relative to the face 26 such that the laser module 36, when installed in the inner cavity 37, emits a laser aiming beam which is aligned substantially perpendicular to the face without need for further optical alignment. The shaft mounting hole 33 is also formed in the top portion of the head 22 during the casting process so as to internally connect to the inner cavity 37. As shown in FIG. 3, the first wire 46 and the second wire 47 are routed from the laser module 36 through the aforementioned communicating cavities and through the hollow inner portion 49 of the shaft 21 to couple to a voltage source which is located and controlled from the grip end of the shaft.

To complete the electrical circuit from the laser generating module 36 to the first pole of the voltage source, the first wire lead 46 from the laser generating module 36 is connected by a well known wire connector 48 to extension lead 46' which is routed through the shaft 21 to couple to the first pole of the voltage source located in the second end of the shaft. If the shaft is fabricated from a non-conductive material, such as a plastic resin, the second wire lead 47 from the laser generating module 36 is connected, as described above, to extension lead 47' which is routed through the shaft to couple to the second pole of the voltage source.

If the shaft 21 is fabricated from a conductive material, the conductive shaft referred to by reference number 121 (FIG. 3A) can be used to couple the second pole of the voltage source to the wire lead 47. This is accomplished, as will be explained in more detail below, by having the second pole of the voltage source located at the grip 24 end of the club connected electrically to the second end of the shaft 121. At the head end of the shaft, the second lead wire 47 from the laser generating module 36 located in the club head 22 is connected electrically to the first end of the shaft 121 by any one of a number of wire connecting techniques such as a wire clip 34 affixed between the head 22 and the shaft 121 in the shaft mounting hole 33, as shown in FIG. 3A. Thus, the electrically conductive shaft 121 couples the second wire lead 47 from the laser generating module 36 to the second pole of the voltage source.

Unlike prior art devices, this embodiment discloses a laser aiming system that incorporates a mounting arrangement which completely conceals the laser generating module 36 in the head 22 of the club 20 in a substantially sealed enclosure. In addition, and without the need for external mounting brackets, an add-on housing, costly fiber optic cables and/or mirrors, and without affecting the appearance of the club this novel mounting arrangement permits the laser aiming beam 38 to be emitted in an essentially horizontal direction above the golf ball 27 perpendicular to the face 26 at a location above the face 26 where the golf ball 27 is positioned to be struck. Further, the communicating internal cavities, inner cavity 37 and shaft mounting hole 33, provide a sealed internal route for the wire connection from the laser module 36 contained in the first end of shaft 21 to the voltage source contained in the second end of the shaft 21.

Figure 4:
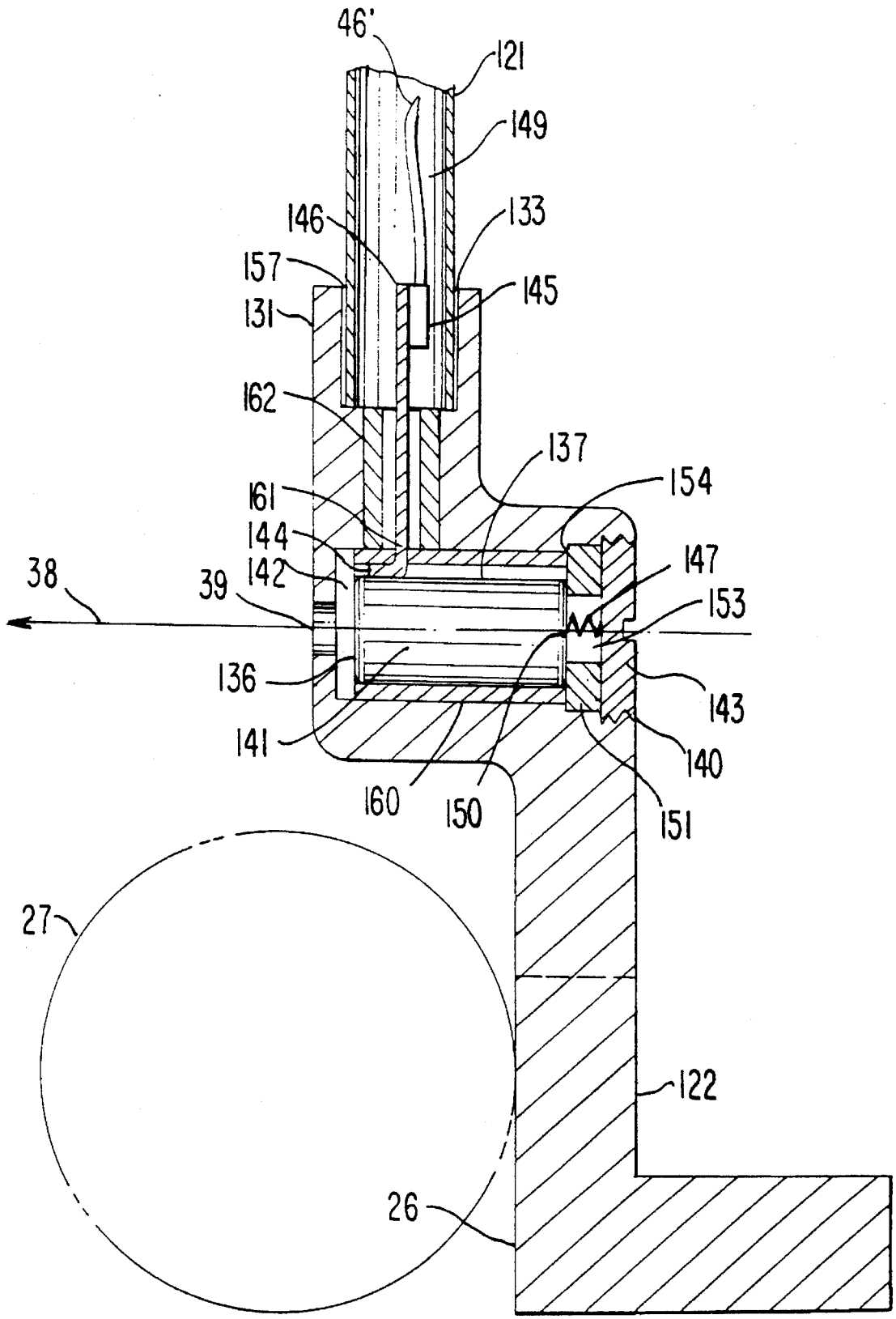
FIG. 4 is an enlarged fragmentary sectional view of the putter head shown in FIG. 2A taken along lines 4—4.

Turning now to FIG. 4, in the drawing there is illustrated an alternate embodiment of the invention offering certain variations over the first embodiment. Principally, the laser module in the alternate embodiment includes an outer electrically conductive cylindrical housing which is used to couple the first pole of the voltage source to the laser module rather than a first insulated wire lead. Also, the module has a conductive rear planar surface which is electrically isolated from the cylindrical housing and which is used to couple the second pole of the voltage source to the laser module rather than a second insulated wire lead. In this embodiment, the laser module is easily installed and removed without having to make or break lead wire connections.

FIG. 4 is an enlarged sectional view, taken along lines 4—4, of an alternate embodiment of the club 20 illustrated in FIG. 2A. In this embodiment, the head is formed from an electrically conductive material such as brass and is referred to by reference number 122. The shaft 121 is also fabricated from an electrically conductive material such as steel. FIG. 4 delineates the mounting arrangement of an alternate laser beam generating module 136 contained in an inner cavity 137 in the head 122. The laser beam generating module 136 employed in this embodiment, having conductive outer surfaces 141 and 150 which are used to couple the voltage source to the laser beam generating module 136, is well known in the industry and may be purchased from Lyte Optronics, Santa Monica, Calif.

As shown in FIG. 4, the conductive cylindrical module housing 141 fits laterally into an insulating sleeve 160 in the inner cavity 137 of the head 122. A first electrically conductive element 146, preferably formed with a resilient spring tab 144 on one end and a well known wire clip 145 on the other end, is coupled to the first pole of the voltage source via the extension wire 46'. The conductive element 146 extends from a hollow inner portion 149 through a shaft mounting hole 133 and through an opening 161 in the insulating sleeve 160 into the inner cavity 137. The module housing 141 is electrically isolated from the inner cavity 137 of the electrically conductive head 122 by the insulating sleeve 160 and the conductive element 146 is isolated from a hosel 131 by a hosel insulator sleeve 162. In the inner cavity 137, tile spring tab 144 of the conductive element 146 is in biased contact with the module housing 141 of the laser generating module 136 thereby coupling it to the first pole of the voltage source, described in detail hereinafter. Also, in the inner cavity 137, a second electrically conductive element 147, preferably in the form of a coil spring, is in biased contact with the rear conductive surface 150 of the laser generating module 136 coupling it to the second pole of the voltage source via an electrically conductive threaded cap 143, via the conductive head 122 and, as will be explained below, via the electrically conductive shaft 121 which is coupled to the second pole of the voltage source.

As was previously indicated, it is desirable that the putter head 122 provide a substantially waterproof enclosure in which to mount the laser generating module 136. A substantially sealed enclosure is provided in this embodiment in much the same manner as was delineated in the first embodiment with additional features described hereinafter. There is shown in FIG. 4, the inner cavity 137 which has a transparent lens 142 suitably mounted in its front end thereby sealing the lateral bore 39. A rear access opening 140 of the inner cavity 137 is closed by a conductive threaded cap 143. A doughnut shaped resilient gasket 151 is sandwiched between the rear surface of the laser module 136 and the threaded cap 143 and a clearance hole 153 in the doughnut shaped gasket 151 provides an opening through which the second conductive element 147 maintains a biased electrical connection between the rear contact surface 150 of the laser generating module 136 and the cap 143. In addition, the doughnut shaped gasket 151 creates a substantially waterproof seal between the threaded cap 143 and a lip 154 formed in the rear end of the inner cavity 137. To complete the sealing of the inner cavity 137, the shaft 121 is bonded to the head 122 by a hosel glue joint 157 applied to the interface between the outside diameter of the shaft 121 and the inside diameter of the shaft mounting hole 133. To enhance the electrical conductivity of the interface between the conductive shaft 121 and the conductive head 122, the glue joint 157 may be made with conductive glue which is well known in the industry for this purpose.

An advantage of the embodiment shown in FIG. 4 is that the laser generating module 136 is electrically coupled to the voltage source through spring contacts, a first conductive element 146 and a second conductive element 147, rather than lead wires. By employing this mounting arrangement, the user may easily remove and replace the laser generating module 137 without the need to disconnect and reconnect lead wire connections.

Unlike prior art devices, this embodiment discloses a laser aiming system that incorporates a mounting arrangement which conceals the laser generating module 136 in the head 122 of the club in a substantially waterproof enclosure. Further, and without the need for an external mounting bracket, an add-on housing, costly fiber optic cables and/or mirrors, this novel mounting arrangement permits the laser generating module 137 to be mounted and concealed such that the laser aiming beam 38 is emitted in an essentially horizontal direction above the golf ball 27 perpendicular to the face 26 at a location above the face 26 where the golf ball 27 is positioned to be struck.

Figure 5:
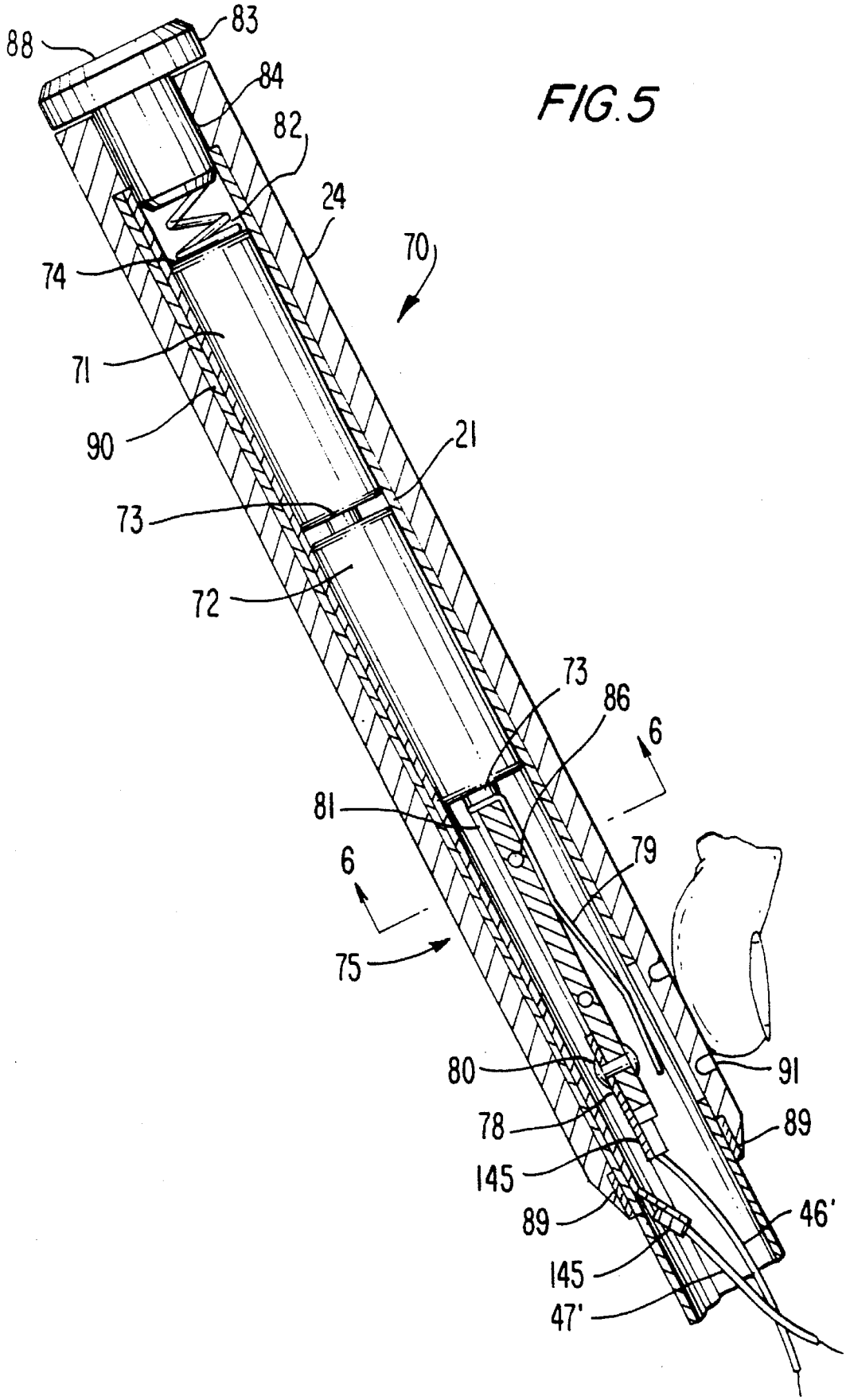
FIG. 5 is a fragmentary sectional view of a voltage source and switch contained in the grip of the putter shown in FIG. 1.
Figure 5A:
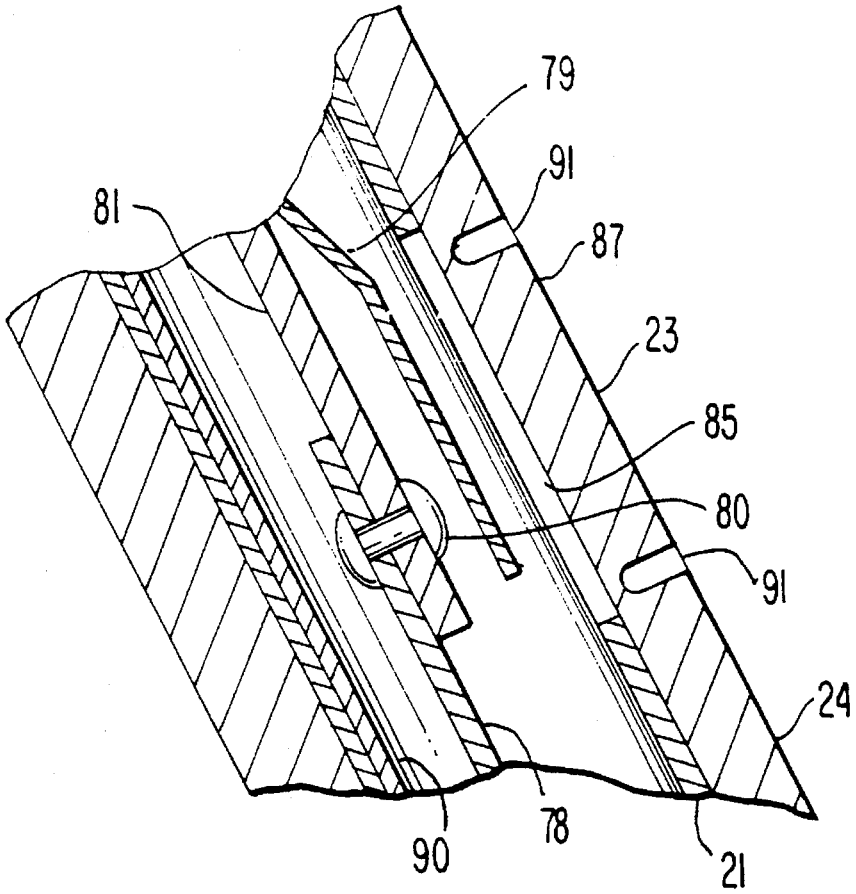
FIG. 5A is an enlarged fragmentary sectional view of the switch shown in FIG. 5.
Figure 6:
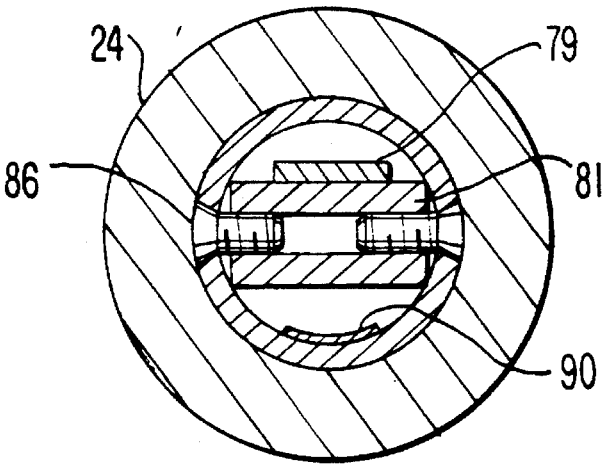
FIG. 6 is an enlarged sectional view of the switch illustrated in FIG. 5 taken along lines 6—6.

FIGS. 5, 5A and 6 delineate a voltage source, generally referred to by reference character 70, located in the second end of the shaft 21. The upper portion of the second end of the shaft 21 is covered by the grip 24 which is used by the golfer to hold the club. Typically, the grip is molded from a resilient flexible material such as neoprene or silicone rubber. In the present invention, the grip 24 covers substantially that portion of the second end of the shaft 21 in which the voltage source 70 is mounted.

The voltage source 70 consists of at least one battery 71 having a first electrical pole 73 and a second electrical pole 74. A second battery 72 may also be included as part of the voltage source 70. Also, located in the second end of the shaft 21 adjacent to the voltage source 70 is a switch, generally referred to by reference number 75, having a normally open switch element 79 and a fixed switch element 80. Both elements are mounted on a contact support 81, formed from an insulating material such as plastic, which is affixed to the shaft 21 by any one of a number of fastening means such as a plurality of rivets. Each rivet in the FIGS. 5 and 6 is referred to by reference character 86. All mounting rivets 86 are located in the shaft 21 within the envelope of the grip 24.

If the shaft 21 is fabricated from an insulating material, as previously described, the second electrical pole 74 of the voltage source 70 is coupled to the extension lead 47' through an electrically conductive strip 90 suitably affixed to the shaft 21. Tile strip 90, a thin conductive metallic element of arcuate cross section, is interposed between the outside insulative housings of the batteries 71 and 72 and the inside diameter of the shaft 21. The strip 90 electrically couples the second pole 74 of the voltage source 70 by means of a conductive spring member 82 in biased contact between the second electrical pole 74 and the strip 90 to the extension lead 47' which is connected to the strip 90 by a wire clip 145 formed on an end of the strip 90.

If the shaft 21 is fabricated from a conductive material, the second electrical pole 74 of the voltage source 70 is coupled directly to the conductive shaft 121 (FIG. 4) through the conductive spring member 82 held in biased contact between the second electrical pole 74 and the conductive shaft 121 by a grip cap 83. Because laser diode modules are sensitive to electrostatic voltages, it is desirable that the second electrical pole 74 which is electrically connected to the shaft 121 is the negative or ground potential of the typical battery 71 as shown in FIG. 5. The grip cap 83, preferably manufactured from the same type of rubber material as the grip 24, is secured in position by an interference fit within a battery access hole 84 in the grip 24. When the conductive shaft 121 is used to couple the second electrical pole 74 of the voltage source 70 to either laser generating module 36 (FIG. 3) or laser generating module 136 (FIG. 4), the conductive strip 90 is not required and, therefore, need not be included as part of the laser aiming system.

As shown in FIGS. 5, 5A and 6, the switch 75 is located in the shaft 21 such that the first electrical pole 73 of the voltage source 70 contacts the normally open switch element 79. Deflecting the normally open switch element 79 causes it to contact the fixed switch element 80 and thereby couple it to the extension lead 46' through a switch element 78 to which the extension lead 46' is attached by the wire clip 145 formed on an end of the switch element 78. Closing the normally open switch element 79 turns on the laser aiming beam 38 (FIG. 1).

As shown in FIG. 5A, the switch element 79 is located adjacent a shaft access opening 85 through which a grip segment 87 may be deformed by finger pressure applied at a pressure point 23 to deflect the switch element 79. A relief groove 91 is formed in the grip 24 to weaken the grip 24 in order to be able to push the grip segment 87 through the shaft access opening 85 with normal finger pressure. As previously mentioned, typical golf club grips are molded from rubber-like materials and the relief groove 91 is easily formed into its outside surface. Note that the relief groove 91 does not create an opening in the grip 24 through which moisture or dust may enter into the hollow portion of the shaft 21 via the shaft access opening 85.

As shown in FIG. 5, batteries 71 and 72 are replaced by means of the battery access hole 84 located in the butt end 88 of the grip 24. An interferance fit between the battery access hole 84 and the grip cap 83 seals the battery access hole 84. The sealing of the voltage source 70, contained within the envelope of the grip 24, is completed by a grip glue joint 89 which seals the interface between the grip 24 and the second end of the shaft 21.

The foregoing embodiments of the present invention disclose a substantially sealed chamber arrangement in the head of the club in which is mounted a laser aiming module. In addition, there is disclosed a substantially sealed chamber arrangement in the grip of the club in which is mounted the voltage source and switch for energizing the laser aiming module. The aforementioned chamber arrangements are sealed to opposite ends of the shaft and communicate with the hollow inner portion of the shaft in which the electrical connection between the laser module and the voltage source is accomplished. Unlike prior art devices, this combination of aforementioned elements provides a substantially dust and waterproof enclosure in which to mount all of the components of the self-contained putter laser aiming system of the present invention.

It is also to be understood that the present invention is not limited to the precise details of structure shown and set forth in this specification for obvious modifications will occur to those skilled in the art to which the invention pertains.

What is claimed is:

1. A golf club putter with laser aiming comprising:

a shaft having a hollow length portion;

a head secured at a first end of said shaft having a face on a front side thereof for striking a golf ball and a hosel on a top side of said head securing said first end of said shaft;

a grip affixed at a second end of said shaft;

said head forming an inner cavity having a lateral bore in a front side thereof and including an access opening in a rear end thereof;

said inner cavity communicating with said hosel and said hollow length portion of said shaft;

a laser module mounted in said inner cavity adapted to emit a laser beam coincident with the axis of said lateral bore;

said laser module having first and second connection means for coupling opposite polarity electrical potentials from a voltage source to said laser module to cause said laser module to emit said laser beam;

said first connection means coupling to said voltage source through said inner cavity, said hosel, and said hollow length portion of said shaft; arid said laser beam being employed by a user of said club for controlling the direction of said golf ball.

2. A golf club putter with laser aiming in accordance with claim 1 wherein said first connection means is a first conducting wire connected to said laser module.

3. A golf club putter with laser aiming in accordance with claim 1 wherein said second connection means is a second conducting wire connected to said laser module coupling to said voltage source through said inner cavity, said hosel and said hollow length portion of said shaft.

4. A golf club putter with laser aiming in accordance with claim 1 wherein said second connection means is an electrically conductive shaft coupling said laser module to said voltage source.

5. A golf club putter with laser aiming in accordance with claim 1 wherein said voltage source is contained in said hollow portion of said shaft.

6. A golf club putter with laser aiming in accordance with claim 1 wherein said inner cavity contains a lens and means for securing said lens in said front side thereof.

7. A golf club putter with laser aiming in accordance with claim 1 wherein said access opening is closed by a cap removeably inserted in said access opening.

8. A golf club putter with laser aiming in accordance with claim 7 wherein said cap is threadedly engaged in said access opening.

9. A golf club putter with laser aiming in accordance with claim 7 wherein said inner cavity contains at least one gasket sandwiched between said removable cap and the rear end of said laser module.

10. A golf club putter with laser aiming comprising:

an electrically conductive shaft having a hollow length portion;

an electrically conductive head secured at a first end of said shaft having a face on a front side thereof for striking a golf ball and a hosel on a top side of said head securing said first end of said shaft;

a grip affixed to a second end of said shaft;

said head including an inner cavity having a lateral bore including an opening through said front side and having an access opening in a rear end thereof;

said inner cavity communicating with said hosel and said hollow length portion of said shaft;

a laser module mounted in said inner cavity adapted to emit a laser beam coincident with the axis of said lateral bore;

said laser module having first and second conductive surfaces coupling opposite polarity electrical potentials, a first pole and a second pole, from a voltage source to said laser module to cause said laser module to emit a laser beam through said lateral bore;

a first conductive element coupled to said first pole of said voltage source extending from within said hollow length portion of said shaft through said hosel into said inner cavity, isolated from said shaft and said inner cavity, contacting said first conductive surface of said laser module;

a second conductive element contacting said second conductive surface of said laser module coupling to said second pole of said voltage source through said conductive head and said conductive shaft; and said laser beam being employed by a user of said club for controlling the direction of said golf ball.

11. A golf club putter with laser aiming in accordance with claim 10 wherein said first conductive surface of said laser module is on an outer cylindrical housing thereof.

12. A golf club putter with laser aiming in accordance with claim 10 wherein said second conductive surface of said laser module is on a rear outer planar surface thereof.

13. A golf club putter with laser aiming in accordance with claim 10 wherein said voltage source is contained in said hollow portion of said shaft.

14. A golf club putter with laser aiming in accordance with claim 10 wherein said inner cavity contains a lens and means for securing said lens in said front end thereof.

15. A golf club putter with laser aiming in accordance with claim 10 wherein said access opening is closed by an electrically conductive cap removeably inserted in said access opening.

16. A golf club putter with laser aiming in accordance with claim 15 wherein said electrically conductive cap is threadedly engaged in said access opening.

17. A golf club putter with laser aiming in accordance with claim 15 wherein said inner cavity contains at least one gasket sandwiched between said electrically conductive cap and the rear end of said laser module.

18. A golf club putter with laser aiming in accordance with claim 15 wherein said electrically conductive cap electrically couples to said second pole of said voltage source through said conductive shaft and said conductive head and couples to said second conductive surface of said laser module through said second conductive element.

19. A golf club putter with laser aiming in accordance with claim 18 wherein said second conductive element is a resilient spring in biased contact between said electrically conductive cap and said second conductive surface.

20. A golf club putter with laser aiming in accordance with claim 10 wherein said second polarity of said voltage source is at ground potential.

21. A golf club putter with laser aiming comprising:

a shaft having a hollow length portion;

a head secured at a first end of said shaft having a face on a front side thereof for striking a golf ball and a hosel on a top side of said head securing a first end of said shaft;

a grip secured at a second end of said shaft;

said head having an inner cavity communicating with said hosel and said hollow length portion of said shaft;

a laser module mounted in said inner cavity having first and second connection means, a voltage source, said first and second connection means coupling first and second electrical poles from said voltage source to said laser module to cause said laser module to emit a laser beam through a front facing bore in said head;

said voltage source and a switch controlling said voltage source being located in said second end of said shaft;

said switch having first and second normally open switch elements which, when closed, couple said first pole of said voltage source to said first connection means of said laser module;

said first switch element being coupled to said first electrical pole of said voltage source;

said second switch element being coupled to said first connection means of said laser module through said hollow length portion of said shaft;

a spring member in said second end of said shaft connecting said second electrical pole of said voltage source to a conducting means for coupling said voltage source to said laser module;

said conducting means being coupled to said second connection means of said laser module; and said first and second switch elements being closed by finger pressure applied through said grip.

22. A golf club putter with laser aiming in accordance with claim 21 wherein said voltage source is at least one battery held in position against said first switch contact by said spring member secured in said second end of said shaft by a grip cap.

23. A golf club putter providing a substantially sealed enclosure for mounting a laser aiming system therein comprising:

a shaft having a hollow length portion;

a head secured at a first end of said shaft having a face on a front side thereof for striking a golf ball and a hosel on a top side of said head securing a first end of said shaft;

a grip affixed at a second end of said shaft;

said head including an inner cavity having a lateral bore including an opening through said front side and having a rear access opening in an end thereof;

said inner cavity communicating with said hosel and said hollow length portion of said shaft;

said lateral bore being sealed by a lens and means for securing said lens in a front end thereof;

said access opening being sealed by a cap;

said shaft being sealed to said hosel by a hosel glue joint;

said grip being sealed to said second end of said shaft by a grip glue joint; and an access opening in said grip being closed by a grip cap having an interference fit with said second end of said shaft.

24. A golf club putter providing a substantially sealed enclosure for mounting a laser aiming system therein in accordance with claim 23 wherein said shaft and said head are electrically conductive and said glue joint sealing said first end of said shaft to said head is made with electrically conductive glue.

* * * * *